United States Patent [19]

White

[11] 4,013,537

[45] Mar. 22, 1977

[54] ELECTROLYTIC CELL DESIGN

[75] Inventor: Donald Elias White, Richfield, Ohio

[73] Assignee: The B. F. Goodrich Company, Akron, Ohio

[22] Filed: June 7, 1976

[21] Appl. No.: 693,634

[52] U.S. Cl. ..... 204/256; 204/98; 204/128; 204/254; 204/280; 204/289

[51] Int. Cl.[2] ..... C25B 1/16; C25B 1/26; C25B 11/02; C25B 13/02

[58] Field of Search ..... 204/94, 95, 98, 128, 204/252, 254, 255, 258, 266, 280, 289, 301, 282, 256

[56] References Cited

UNITED STATES PATENTS

| | | | |
|---|---|---|---|
| 1,374,976 | 4/1921 | Allen et al. | 204/289 X |
| 1,420,037 | 6/1922 | Harris | 204/289 X |
| 1,856,663 | 5/1932 | Smith | 204/280 X |
| 3,809,630 | 5/1974 | DeNora et al. | 204/266 X |
| 3,855,104 | 12/1974 | Messner | 204/266 X |
| 3,871,988 | 3/1975 | Harke et al. | 204/266 X |

*Primary Examiner*—Arthur C. Prescott
*Attorney, Agent, or Firm*—Harry F. Pepper, Jr.; W. A. Shira

[57] ABSTRACT

An electrolytic cell is divided into two compartments by an electrolyte separator. Each compartment contains an electrode which has a surface adjacent the separator. These surfaces each comprise at least one ridge and at least one groove. A ridge of one electrode is opposite a groove of the other electrode and extends at least partially within the groove, thereby retaining the electrolyte separator partially within the groove. Each ridge has a crown portion which is positioned nearest the separator. The crown portions may be tapered and may comprise a nonconductive insulating material.

5 Claims, 1 Drawing Figure

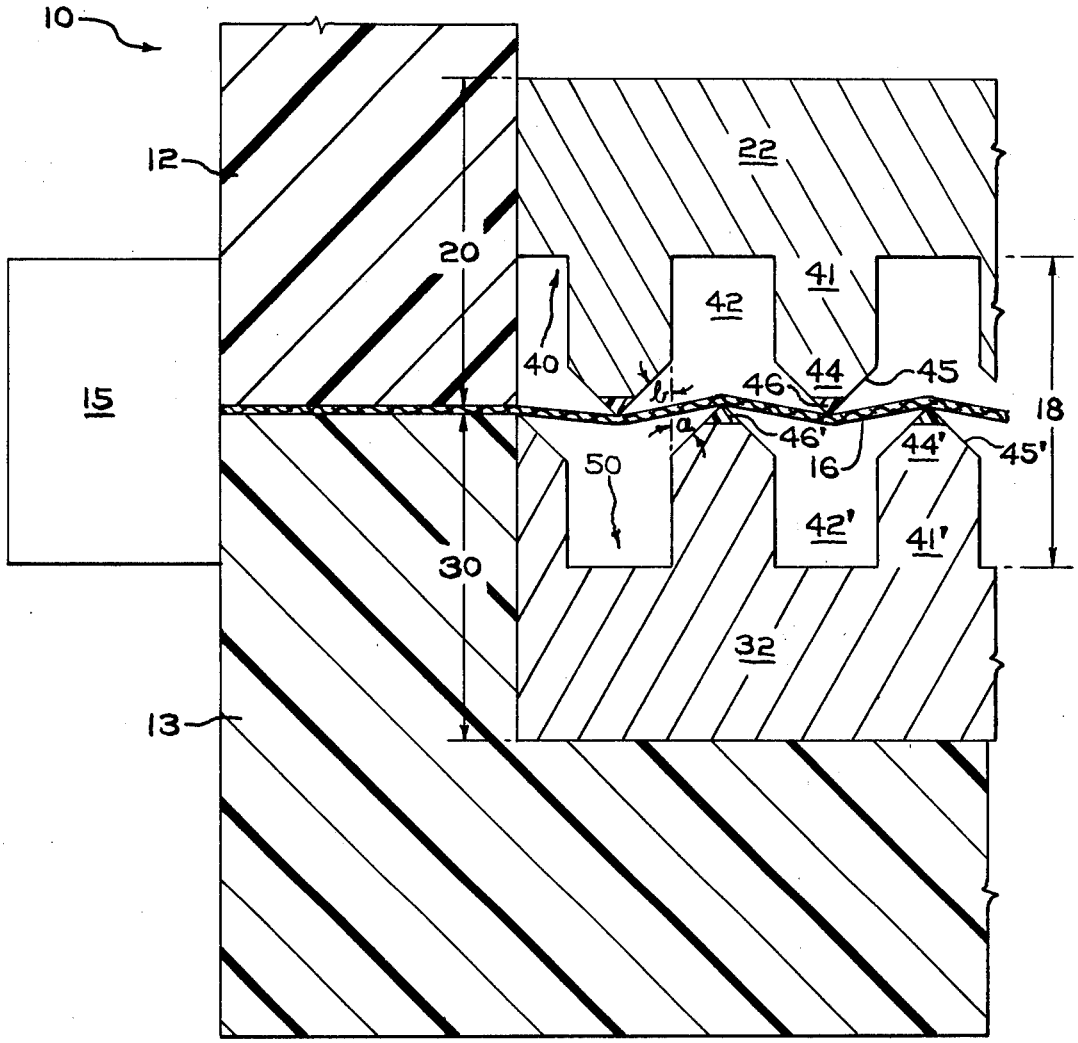
10
12
13
15
20
30
22
41
42
40
44
45
46
46'
16
44'
45'
18
50
42'
41'
32
b
a

ELECTROLYTIC CELL DESIGN

BACKGROUND OF THE INVENTION

This invention relates to electrolytic systems and more particularly to electrolytic cell design.

Several types of electrolytic processes and cell designs are well known in many industrial branches of electrochemistry. "Diaphragm" type cells are often used in the electrolysis of aqueous solutions. Diaphragm cells generally have anolyte and catholyte compartments which are separated by an electrolyte separator such as a diaphragm or membrane. The compartments contain an anode and a cathode, respectively. Electrolyte separators prevent interaction of the anolyte and catholyte and separate the gaseous products evolving from each cathode. In the chlor-alkali industry, for example, cells having electrolyte separators are widely used in the electrolysis of sodium chloride brine to produce sodium hydroxide and chlorine gas.

Electrolyte separators may be of the rigid type, such as porous sheets of plastic or ceramic. Plastic or ceramic separators, when saturated with electrolyte, are usually nonselectively conductive to anions and cations.

Separators may also be of the flexible permeable type, such as woven textiles, nonwoven fibrous mattes or ion exchange membranes. Ion exchange membranes can be selectively conductive to either cations or anions.

Flexible separators, such as ion exchange membranes, have several advantages. These separators are not subject to fracture as are rigid separators. Furthermore, because they are generally thin, they are easy to fabricate and have minimal electrical resistance. As the cost of power to operate electrolyte cells increases, the need for these thin, flexible separators becomes more pronounced.

However, a major disadvantage to flexible separators is the swelling that usually occurs upon saturation of a separator with an electrolyte. The degree of swelling is dependent upon the concentration and the temperature of the electrolyte. This swelling can create slack in the separator.

Separator distortion is more likely to occur in a slackened separator. Most electrolytic cells employing separators have pressure differentials between the anolyte and the catholyte. Pressure differentials may be caused by density differences, hydrostatic head or kinetic head differences, etc., between anolyte and catholyte. These forces can cause separator distortion in the form of buckling, weaving or folding. This is particularly true of cells having vertically extending separators. Distortion may lead to a number of malfunctions in the electrolytic cell.

Distortion sometimes is in the form of separator fluttering. This may cause the separator to fail by fatigue at its points of support. Distortion of the separator can block the rise of the product gases and can cause an uneven flow of electrolyte past the electrodes. The distortion may also cause the separator to come into direct contact with an electrode, thereby slowing the electrolysis process at such areas of contact and increasing the current density in other areas. Excessive current densities can result in high "$i^2$ r" drops and overheating.

Presently, there are no adequate means for eliminating separator swelling in flexible separators. In an attempt to eliminate the aforementioned effects of separator swelling, methods of taking up the slack created by the swelling have been devised. For example, in some cells the separator is stretched over a rigid frame and tension is applied by wedges inserted along one or more sides of the frame. As the separator swells, the wedges are pounded into the frame, thereby taking up the slack in the separator.

It is common practice in using some electrolytic cells to attempt to maintain the separator in a flat or planar configuration across the entire width and height of the cell. In an attempt to maintain this configuration, separators have been secured and tensioned along their peripheries. However, the aforementioned distortion problems often occur with this separator configuration. When pressure differentials exist on either side of the separator it can require an extremely high tension applied at the peripheries of the separator to pull the separator into a substantially planar position, especially for large separators which will have a larger total surface area. Further complicating the situation is the yield strength of the membrane which cannot be exceeded in any tensioning process. Ion exchange membranes, for example, are relatively thin and have relatively low yield strengths. This may limit the amount of tension that can be applied regardless of the tensioning method used.

One proposed method of coping with the aforementioned distortion problems of flexible separators is supporting a separator in a planar configuration between screens of nonconducting, structurally strong material. However, screens can create problems by blocking the movement of electrolyte and product gas. They can also increase the distance required between electrodes, thereby causing a higher resistance to current flow.

Reinforcing the separator internally with fibers or woven textiles has also been suggested. This may decrease separator swelling but it does not completely eliminate the problem in cells with large separators. Furthermore, non-conductive fibers added to the separator create additional power losses because of the increased difficulty of ion migration.

Separator distortion can also be reduced by the addition of intermediate separator supports in contact with the separator, as, for example, closely spaced nonconducting parallel bars attached to the electrode or the cell frame. Intermediate separator supports can also be in the form of ridges or lands on an electrode surface. The separator can be clamped between the ridges of opposing electrodes. For a vertically extending separator, these ridges usually are also vertical to permit electrolyte and product circulation upwards between the ridges.

Previously used intermediate separator supports, along with other aforementioned attempts at reducing separator distortion, have generally been aimed at maintaining the separator in flat or planar position entirely across the width of the cell. Attempts have been made along this line because it is generally believed that minimum power losses and maximum cell efficiency can be achieved with a flat or planar separator configuration.

SUMMARY OF THE INVENTION

It is an object of the present invention to alleviate separator distortion problems encountered with flexible separator.

It is a further object of the present invention to provide an electrolytic cell in which the electrolyte separator can be maintained in a predetermined configuration without exceeding the yield strength of the separator.

These objects, and other objects of the present invention which will become evident by the following detailed description, are achieved by an electrolytic cell having an electrolyte separator which divides the cell into an anolyte compartment and a catholyte compartment. An anode within the anolyte compartment is opposite a cathode within the catholyte compartment. The anode and cathode each have a surface adjacent the electrolyte separator, the surfaces facing each other. Each of these surfaces comprise at least one ridge and at least one groove, with a ridge of the cathode surface being opposite a groove of the anode surface and extending into the groove in the anode surface. The separator is thereby retained partially within the groove of the anode surface. Each of the electrode surfaces may have a plurality of such ridges and grooves. The ridges and grooves may extend vertically and may be mutually parallel, and equally and alternately spaced. Each ridge of the electrodes has a crown portion nearest the electrolyte separator. The crown portions may be tapered and may comprise a non-conductive insulating material.

BRIEF DESCRIPTION OF THE DRAWING

FIG. 1 is a cross-sectional top view of an electroytic cell of the present invention.

DETAILED DESCRIPTION OF A PRESENTLY PREFERRED EMBODIMENT

FIG. 1 shows a diaphragm-type electrolytic cell 10 for producing chlorine from brine. The cell 10 has cell wall portions, 12 and 13, which are sealed together by suitable means (not shown). The cell wall portions are of polyethylene but may be of any other suitable material well known in the art.

The cell 10 is vertically divided into an anolyte compartment 20 and catholyte compartment 30 by an electrolyte separator 16. The separator 16 is a selectively permeable physical boundary between the anolyte and the catholyte. In the present embodiment, the separator 16 is an ion exchange membrane, but other types of separators, such as diaphragms, may be utilized within the scope of this invention. A separator tensioning device 15 exerts a stress on the separator 16 to help maintain the separator in a predetermined configuration.

A vertically extending anode 22 is positioned in the anolyte compartment 20 adjacent the electrolyte separator 16. A vertically extending cathode 32 is similarly positioned in the catholyte portion 30. The electrodes 22 and 32 have opposing surfaces 40 and 50, respectively, of a design which will hereinafter be described. The region between the opposing surfaces 40 and 50 forms an electrolysis zone 18.

The electrodes 22 and 32 are comprised substantially of graphite, but other electrode materials may be utilized within the scope of this invention. Cathode 32 is directly connected to a voltage source through suitable means (not shown) such as a graphite buss bar. Anode 22 is the anode portion of a bipolar electrode. It should be understood that this invention is particularly applicable to cells having bipolar electrodes. It should, therefore, be noted that the terms "anode" and "cathode" in this specification and in the appended claims may refer not only to unipolar electrodes such as 32 but also to those portions of bipolar electrodes that act as an anode or a cathode.

The anode surface 40 is adapted to be positioned adjacent the electrolyte separator 16. The surface 50 has a plurality of parallel, vertically extending and equally spaced ridges 41 which define a plurality of parallel, vertically extending and equally spaced grooves 42. Similarly, the surface 50 of the cathode 32 has a plurality of parallel, vertically extending, and equally and alternately spaced ridges 41' and grooves 42'.

The anode 22 and cathode 32 are positioned in the electrolytic cell such that the ridges 41' of the cathode 32 are opposite the grooves 42 of the anode 22, and vice versa. The ridges 41 and 41' have crown portions 44 and 44', respectively, which are nearest the separator 16. The crown portions are tapered in the form of chamfers 45 and 45'. However, alternate means of tapering, such as rounding the crown portions, may also be utilized. The tips of the chamfered crown portions 44 and 44' are insulated with any suitable non-conductive material 46 and 46', such as Teflon. This insulating material can reduce the current density at the tips of each ridge 41 and 41'. It may also reduce corrosion at these locations.

The tapered ridges 41 and 41' may be machined out of an electrode having a flat surface. However, some materials, such as graphite, can easily be molded into an electrode having the desired configuration. This latter method is preferable because of the savings in labor and material.

The crown portions 44 of the ridges 41 of the anode are disposed to extend partially within the grooves 42' of the cathode. The ridges 41' of the cathode are similarly disposed within the grooves 42 of the anode. The insulating material 46 and 46' on the crown portions of each electrode is in contact with the separator 16. The ridges 41 and 41' retain portions of the separator 16 within the grooves 42' and 42, respectively, thereby corrugating the separator. This support makes the tension exerted by tensioning device 15 required to maintain a flat surface between the supports independent of the cell width and dependent only upon the distance, or interval width, between electrode ridges.

The overall effect of this "overlapping" of the crown portions 44 and 44' is that the membrane 16 will be corrugated at each crown portion 44 and 44'. Thus, each crown portion of each ridge will act as a support point of the membrane and will oppose any force exerted by the differential densities of the liquids on either side of the membrane.

In the design of previously known cells, it has been customary to maintain the separator in flat configuration entirely across the cell to obtain a uniform current flow. However, this invention utilizes a "corrugated" separator. It has been found that maximum cell efficiency with minimum power consumption can be achieved without utilizing a flat or planar separator configuration across the entire width of the cell if the separator has a predetermined and controlled geometry. The corrugated separator has such a definite geometry, and can more readily be maintained in its predetermined geometry throughout the operation of the cell.

It is presently preferred that the ridges of each electrode extend into the grooves of the other electrode a distance of about 0.1% to 30% of the depth of the groove. Theoretically, any extension of a ridge into a groove will reduce the interval width of the separator, thereby making that interval flatter or more planar with a lesser amount of tension. However, greater depths are acceptable, especially if the ridges have a taper. But, if the ridges extend to a depth of more than 30% of the opposing groove, electrolyte and gas product circulation is more likely to be restricted in a cell of the preferred embodiment.

It should be noted that although tapered ridges are presently preferred, significant separator support can be obtained by extending nontapered ridges into the grooves of opposing electrodes. Furthermore, graphite electrodes having ridges with flat ends may naturally evolve into a rounded shape as the electrolysis process proceeds.

To facilitate a constant current density, which will reduce the power consumed by the cell, it is necessary to control the membrane shape and to adapt the electrodes to this shape. It has been found that the current flow between electrodes will be substantially uniform because the separator is in an essentially flat or planar configuration between the electrode ridges.

Using this invention, the membrane can maintain a planar interface between each ridge thereby maintaining the geometry of the anolyte compartment 20 and the catholyte compartment 30 without the use of separator reinforcing or backup screens. By maintaining these flat membrane surfaces over relatively short distances, a tension less than yield strength of the membrane can create a controlled shape.

Using this controlled corrugated membrane configuration electrodes can be designed in an optimum configuration to create the uniform current density between the electrodes which can reduce the power losses in the cell. Preferably, the angles "*a*" and "*b*" of the tapers 45 and 45' of the anode crown portion 44 and cathode crown portion 44' are equal. Thus, the tapered portions 45 and 45' will be parallel to each other. This permits a more even current density flowing between the electrodes because each path of ion migration will offer about the same current resistance. In a preferred embodiment, the membrane is corrugated just enough to give support. The support required will vary depending upon the density differential of the liquids on either side of the membrane. It should be noted that deep corrugations should be avoided if possible because they may interfere with the circulation of electrolyte and the rise of the product gases. Furthermore, deep corrugations increase the length of membrane between each support point which can cause more distortion because the tension is applied over a longer length.

Advantages can also result from the tapering of the crown portions 44 and 44'. The tapered crown portions decrease the contact area of the ridges on the screens 21 and 31, thereby further increasing the area of the separator 16 that can be effectively utilized. Tapering of the crown portions also provides a greater area for electrolyte and gas product movement. The current density is also made more uniform because the tapered crown portions 44 of the opposing ridges 41 are parallel to and equidistant from each other when the ridges 41 are staggered. Thus all current paths between the ridges offer about the same current resistance.

Although the foregoing structure has been described for the purpose of illustrating a presently preferred embodiment of the invention, it should be understood that many modifications or alternations may be made without departing from the spirit and the scope of the invention as set forth in the appended claims.

I claim:

1. In an electrolytic cell comprising:

a. an anolyte compartment and a catholyte compartment;

b. an electrolyte separator extending between said anolyte and catholyte compartments;

c. an anode within said anolyte compartment having a surface adjacent said electrolyte separator, said anode surface comprising at least one ridge and at least one groove;

d. a cathode within said catholyte compartment having a surface adjacent said electrolyte separator, said cathode surface comprising at least one ridge and at least one groove, wherein said cathode surface substantially faces said anode surface and said at least one ridge of said cathode surface is opposite said at least one groove of said anode surface, the improvement wherein said at least one ridge of said cathode surface extends at least partially into said at least one groove of said anode surface, whereby a portion of said electrolyte separator is retained within said groove of said anode surface.

2. An electrolytic cell as defined in claim 1 wherein said at least one ridge of said cathode surface extends into said at least one groove of said anode surface a distance of about 0.1% to 30% of the depth of said groove.

3. An improvement as defined in claim 1 wherein said at least one ridge of said cathode surface comprises a nonconductive insulating material at the region of contact with said separator.

4. An improvement as defined in claim 1 wherein said electrolytic cell further comprises means for applying tension to said electrolyte separator.

5. An improvement as defined in claim 1 wherein said at least one ridge on said anode and said cathode are tapered, wherein the angle of taper of said anode ridge is equal to the angle of taper of said cathode ridge.

* * * * *